US007834809B2

(12) United States Patent
Tseng et al.

(10) Patent No.: US 7,834,809 B2
(45) Date of Patent: Nov. 16, 2010

(54) MULTI-ANTENNA INTEGRATION MODULE

(75) Inventors: Yi-Wei Tseng, Taipei County (TW); Tsung-Wen Chiu, Taipei County (TW); Fu-Ren Hsiao, Taipei County (TW); Sheng-Chih Lin, Taipei County (TW); Yo-Chia Chang, Taipei County (TW)

(73) Assignee: Advanced Connectek, Inc., Taipei County (TW)

( * ) Notice: Subject to any disclaimer, the term of this patent is extended or adjusted under 35 U.S.C. 154(b) by 270 days.

(21) Appl. No.: 12/185,204

(22) Filed: Aug. 4, 2008

(65) Prior Publication Data

US 2009/0066580 A1 Mar. 12, 2009

(30) Foreign Application Priority Data

Sep. 7, 2007 (TW) ..... 96133398 A

(51) Int. Cl.
*H01Q 1/38* (2006.01)
*H01Q 21/00* (2006.01)

(52) U.S. Cl. ..... 343/700 MS; 343/893

(58) Field of Classification Search ..... 343/700 MS, 343/702, 830, 860, 893
See application file for complete search history.

(56) References Cited

U.S. PATENT DOCUMENTS

| | | | | |
|---|---|---|---|---|
| 6,424,304 | B1 * | 7/2002 | Jan et al. | 343/702 |
| 6,762,730 | B2 * | 7/2004 | Schadler | 343/770 |
| 7,289,071 | B2 * | 10/2007 | Hung et al. | 343/702 |
| 7,639,190 | B2 * | 12/2009 | Shimasaki et al. | 343/702 |

* cited by examiner

*Primary Examiner*—Shih-Chao Chen
(74) *Attorney, Agent, or Firm*—Schmeiser, Olsen & Watts LLP

(57) ABSTRACT

The present invention discloses a multi-antenna integration module, which comprises a first antenna, a second antenna and a common unit. The first antenna further comprises a first feeder cable, a first feeder member, a coupling unit, which has a first and second coupling members, and an extension conductor. The second antenna further comprises a second feeder cable, a radiation conductor and a coupling conductor. The common unit further comprises a common conductor which has a first and second conductor, a common short-circuit member and a common ground member. In the present invention, the design of the common unit integrates the radiation conductors, short-circuit members and ground members of different antenna systems into a single structure, whereby the isolation effect is promoted, and the signal interference among different antennae is decreased, and the space occupied by the antenna layout is reduced.

12 Claims, 5 Drawing Sheets

MULTI-ANTENNA INTEGRATION MODULE

BACKGROUND OF THE INVENTION

1. Field of the Invention

The present invention relates to a multi-antenna integration module, particularly to a multi-antenna integration module having a common unit.

2. Description of the Related Art

With the popularization of wireless communication, there are also many advances in antenna technology. Particularly, many types of integrated antenna systems have been developed to meet the tendency of miniaturizing antennae and fabricating multi-frequency communication devices, wherein different antenna structures are integrated into a single antenna module to decrease the resonant length of antennae and reduce the size of antenna systems.

Refer to FIG. 1*a* for a conventional assembly antenna of a dual-mode device. The conventional assembly antenna comprises a ground plane 13, a first antenna 14, a second antenna 15, a first coaxial feeder cable 16 and a second coaxial feeder cable 17. The rectangular ground plane 13 has a first ground point 132 and a second ground point 133. The first antenna 14 is arranged near an upper edge 131 of the ground plane 13 to implement the operation of a first network. The second antenna 15 is also arranged near the upper edge 131 of the ground plane 13 to implement the operation of a second network. The abovementioned antenna structure can satisfy the requirement of multi-frequency communication systems, such as a dual-frequency communication device or a dual-frequency WLAN (Wireless Local Area Network) system.

Refer to FIG. 1*b* and FIG. 1*c* for the measurement results of the return loss and isolation of the first antenna and the second antenna of the prior art. When defined by a return loss of less than −7.3 dB, the operation bandwidth of the first antenna covers the frequency bands of the GSM (21), DCS (22) and PCS (22) mobile communication systems. The first antenna has an isolation of less than −20 dB. The operation bandwidth of the second antenna covers the 2.4 GHz (31) and 5 GHz (32) frequency bands of WLAN. The second antenna also has an isolation of less than −20 dB.

The first antenna 14 and the second antenna 15 of the prior art have a traditional Planner Inverted F Antenna structure. When the first antenna 14 and the second antenna 15 are integrated into a single antenna module, they have to be separated by an appropriate spacing (d) to prevent from radiation interference. Thus, the overall dimensions of the antenna structure increase. As the spacing between the two antennae is hard to control, the radiation efficiency of the integrated antennae is also hard to increase. Further, antenna isolation is also likely to be limited in the prior art.

SUMMARY OF THE INVENTION

One objective of the present invention is to provide a multi-antenna integration module, which uses a structure having a common conductor, a common short-circuit member and a common ground member as the common radiator of several antenna systems, whereby the module of the present invention not only occupies much less space but also is easy-to-layout and easy-to-assemble for various electronic devices.

Another objective of the present invention is to provide a multi-antenna integration module, wherein the design of a common unit is used to integrate several antenna structures into a single structure, whereby the interference among different antennae is reduced, and whereby the isolation and the radiation gain are increased.

To achieve the abovementioned objectives, the present invention proposes a multi-antenna integration module, which comprises a first antenna, a second antenna and a common unit. The first antenna further comprises a first feeder cable, a first feeder member, a coupling unit and an extension conductor. The coupling unit has a first coupling member and a second coupling member. The second antenna further comprises a second feeder cable, a radiation conductor and a coupling conductor. The common unit further comprises a common conductor, a common short-circuit member and a common ground member. The common conductor has a first conductor and a second conductor. The first feeder cable is connected to one end of the feeder member, and another end of the feeder member is connected to one side of the first coupling member. A gap is formed in between another side of the first coupling member and one side of the second coupling member. The extension conductor extends from the first coupling member. The second feeder cable is connected to one end of the radiator conductor. Another end of the radiator conductor is connected to one side of the coupling conductor. A gap is formed in between another side of the coupling conductor and one side of the second conductor. The first conductor is connected to another side of the second coupling member. One end of the common short-circuit member is connected to the junction of the first conductor and the second conductor. Another end of the common short-circuit member is connected to the common ground member.

In the first antenna of a first embodiment of the present invention, a feed-in signal is input from the first feeder cable and coupled to the first conductor of the common conductor by the feeder member and the coupling unit. The common conductor receives the electrically coupled signal of the first antenna and transmits it to the common short-circuit member and the common ground member. Thus, the coupling unit, the extension conductor and the common unit cooperate to form the main radiation structure of the first antenna, wherein the common conductor and the extension conductor are respectively used to excite a low-frequency resonant mode and a high-frequency resonant mode of the first antenna. The feeder member and the coupling unit respectively have an inductive reactance and a capacitive reactance. The feeder member and the coupling unit jointly form a resonant structure to realize two functions: regulating the input impedance of the first antenna to make the excitation mode thereof have a superior impedance matching; and appropriately modulating the resonant reactance to create a filtering effect and effectively isolate the signal of the second antenna from the first antenna, whereby the first antenna can be exempted from the signal interference of the second antenna, and the isolation effect between the two antennae is promoted.

In the second antenna of this embodiment, a feed-in signal is input from the second feeder cable and coupled to the second conductor of the common conductor by the radiation conductor and the coupling conductor. The common conductor receives the electrically coupled signal of the second antenna and transmits it to the common short-circuit member and the common ground member. Thus, the radiation conductor, the coupling conductor and the common unit cooperate to form the main radiation structure of the second antenna, wherein the common conductor is used to excite a resonant mode of the second antenna. Via an appropriate design, the radiation conductor has an inductive reactance; the coupling conductor together with the second conductor has a capacitive reactance. The radiation conductor, the coupling conductor and the second conductor jointly form a resonant structure having two functions: regulating the input impedance of the second antenna to make the excitation mode thereof have a superior impedance matching; and appropriately modulating the resonant reactance to create a filtering effect and effectively isolate the signal of the first antenna from the second antenna, whereby the second antenna can be exempted from the signal interference of the first antenna, and the isolation effect between the two antennae is promoted.

The present invention also has a second embodiment similar to the first embodiment except the second antenna additionally has a matching member. One end of the matching member is connected to one side of the radiation conductor, and another end of the matching member is connected to the common ground member. The matching member is used to modulate the impedance matching of the second antenna so that the system of the second antenna can have a better operation bandwidth. In the second embodiment, the extension portion of the radiation conductor, which is connected to the coupling conductor, is fabricated into a serpentine shape to increase the inductive reactance of the second antenna, whereby the filtering effect of the second antenna is increased, and the isolation effect between two antennae is promoted.

In the present invention, the design of the common unit integrates the radiation conductors, short-circuit members and ground members of different antenna systems into a single structure, whereby different antenna systems can share a common radiator. Via the design of feeding signal into the resonant structure, the present invention is exempted from mutual signal interferences of different antennae, and the gain of antenna radiation is free of the influence of signal interferences. Via integrating several sets of antennae into a single structure, the present invention can solve the conventional problem that an electronic device has to be embedded with several sets of antennae and thus can reduce the space occupied by the antenna layout. Therefore, the multi-antenna integration module of the present invention is easy-to-layout and easy-to-assemble for various electronic devices.

Below, the embodiments are described in detail to make easily understood the technical contents of the present invention.

DETAILED DESCRIPTION OF THE INVENTION

Figure 1A:
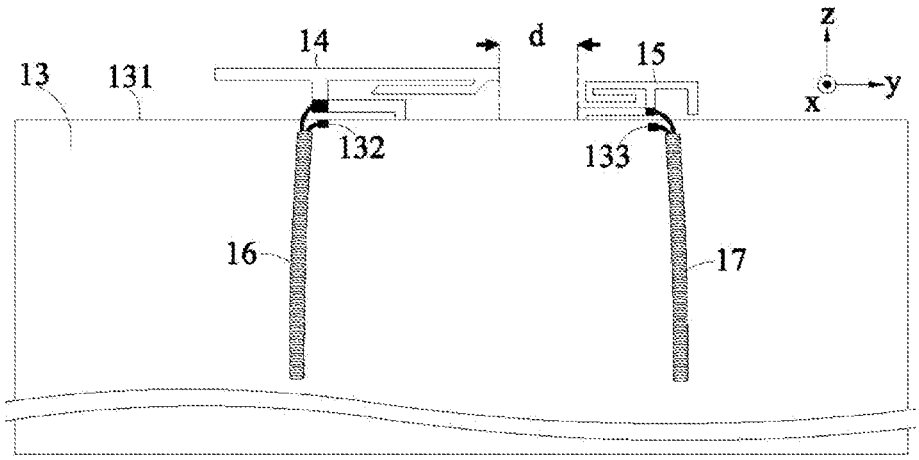
FIG.1a (PRIOR ART)
FIG. 1*a* is diagram schematically showing a conventional assembly antenna of a dual-mode device.
Figure 1B:
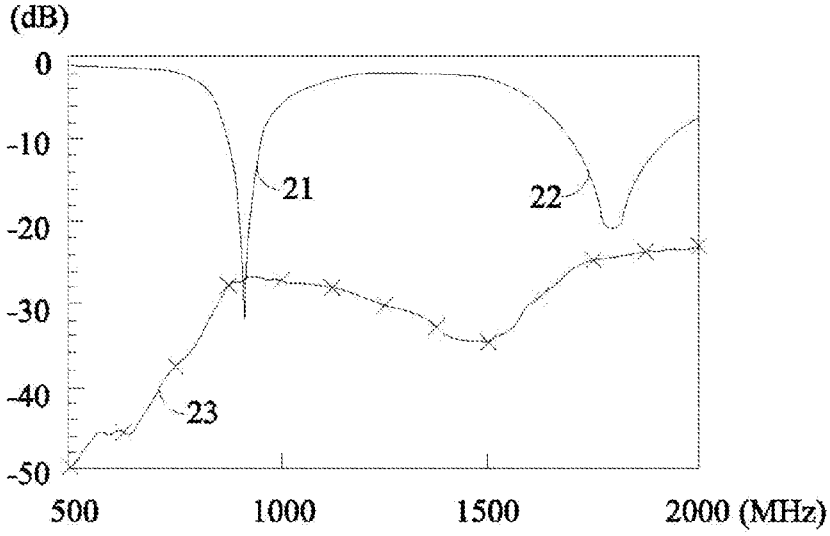
FIG.1b (PRIOR ART)
FIG. 1*b* is a diagram showing the measurement results of the return loss and isolation of a first antenna of a prior art.
Figure 1C:
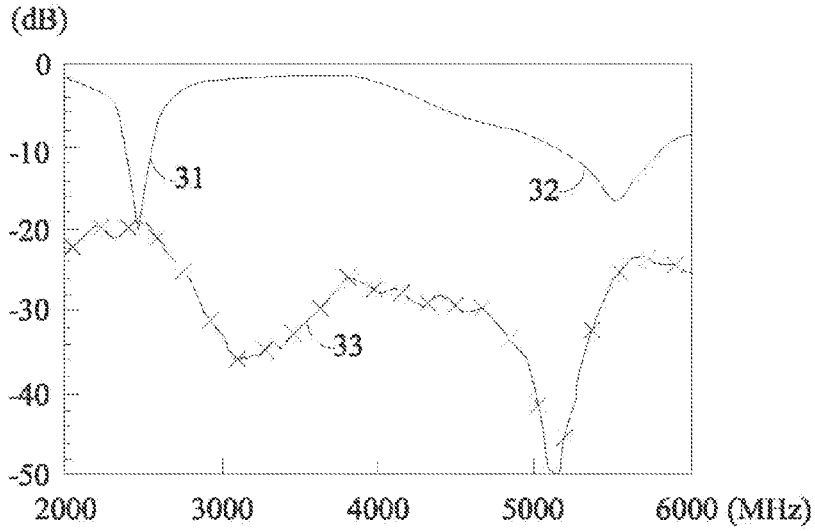
FIG.1c (PRIOR ART)
FIG. 1*c* is a diagram showing the measurement results of the return loss and isolation of a second antenna of a prior art.
Figure 2:
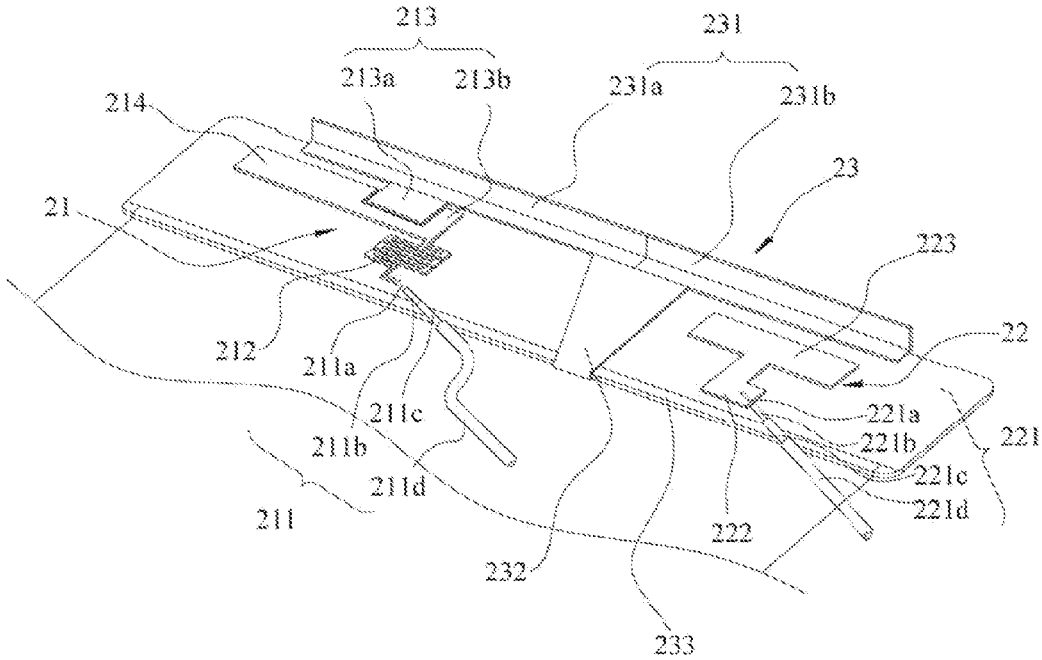
FIG. 2 is a perspective view of a multi-antenna integration module according to a first embodiment of the present invention.

Refer to FIG. 2 a perspective view of a multi-antenna integration module according to a first embodiment of the present invention. The multi-antenna integration module of the present invention comprises a first antenna 21, a second antenna 22 and a common unit 23. The first antenna 21 further comprises a first feeder cable 211, a first feeder member 212, a coupling unit 213 and an extension conductor 214. The coupling unit 213 has a first coupling member 213*a* and a second coupling member 213*b*. The second antenna 22 further comprises a second feeder cable 221, a radiation conductor 222 and a coupling conductor 223. The common unit 23 further comprises a common conductor 231, a common short-circuit member 232 and a common ground member 233. The common conductor 231 has a first conductor 231*a* and a second conductor 231*b*.

The first feeder cable 211 is connected to one end of the feeder member 212, and another end of the feeder member 212 is connected to one side of the first coupling member 213*a*. A gap is formed in between another side of the first coupling member 213*a* and one side of the second coupling member 213*b*. Another side of the second coupling member 213*b* is connected to the first conductor 231*a*. The extension conductor 214 extends from the first coupling member 213*a*. The second feeder cable 221 is connected to one end of the radiator conductor 222. Another end of the radiator conductor 222 is connected to one side of the coupling conductor 223. A gap is formed in between another side of the coupling conductor 223 and one side of the second conductor 231*b*. The junction of the first conductor 231*a* and the second conductor 231*b* is connected to one end of the common short-circuit member 232. Another end of the common short-circuit member 232 is connected to the common ground member 233.

The first feeder member 212 of the first antenna 21 has a total length of about 8 mm. The end of the first coupling member 213*a*, which is connected to one end of the feeder member 212, is a rectangle having a length of about 2.5 mm and a width of about 1 mm. The end of the first coupling member 213*a*, which neighbors one side of the second coupling member 213*b*, is a rectangle having a length of about 4 mm and a width of 1 mm. The second coupling member 213*b* has a length of about 3 mm and a width of about 3 mm. The gap between the first coupling member 213*a* and the second coupling member 213*b* has a width of less than 1 mm. The extension conductor 214 has a length of about 14 mm and a width of about 2 mm. The end of the radiator conductor 222 of the second antenna 22, which is connected to the second feeder cable 221, is a rectangle having a length of about 1 mm and a width of about 1 mm. The end of the radiator conductor 222 of the second antenna 22, which is connected to the coupling conductor 223, is a rectangle having a length of about 4.5 mm and a width of about 1.5 mm. The coupling conductor 223 has a length of about 8 mm and a width of about 1.5 mm. The common conductor 231 has a total length of about 55 mm and a width of about 5 mm. The common short-circuit member 232 about has a trapezoid-like shape. One side of the trapezoid-like shape, which is connected with the junction of the first conductor 231*a* and the second conductor 231*b*, has a length of about 7 mm. The other side of the trapezoid-like shape, which is connected with the common ground member 233, has a length of about 3 mm. One inclined side of the trapezoid-like shape, which is near the first antenna 21, has a length of about 9 mm. The other inclined side of the trapezoid-like shape, which is near the second antenna 22, has a length of about 8 mm. The common ground member 233 has a length of about 84 mm and a width of about 0.5 mm.

In the first antenna 21 of this embodiment, a high-frequency feed-in signal is input from the first feeder cable 211 and coupled to the first conductor 231*a* of the common conductor 231 by the feeder member 212 and the coupling unit 213. The common conductor 231 receives the electrically coupled signal of the first antenna 21 and transmits it to the common short-circuit member 232 and the common ground member 233. Thus, the coupling unit 213, the extension conductor 214 and the common unit 23 cooperate to form the main radiation structure of the first antenna 21, wherein the common conductor 231 is used to excite a low-frequency resonant mode of the first antenna 21, and the extension conductor 214 is used to excite a high-frequency resonant mode of the first antenna 21. The feeder member 212 features an inductive reactance, and the coupling unit 213 features a capacitive reactance. The feeder member 212 and the coupling unit 213 jointly form a resonant structure having both the abovementioned features. The resonant structure regulates the input impedance of the first antenna 21 to make the excitation mode thereof have a superior impedance matching. The resonant structure also modulates the resonant reactance to create a filtering effect and effectively isolate the signal of the second antenna 22 from the first antenna 21 lest the signal of the second antenna 22 interfere with the first antenna 21. Thus is improved the isolation effect of the two antennae.

In the second antenna 22 of this embodiment, a high-frequency feed-in signal is input from the second feeder cable 211 and coupled to the second conductor 231*b* of the common conductor 231 by the radiation conductor 222 and the coupling conductor 223. The common conductor 231 receives the electrically coupled signal of the second antenna 32 and transmits it to the common short-circuit member 232 and the common ground member 233. Thus, the radiation conductor 222, the coupling conductor 223 and the common unit 23 cooperate to form the main radiation structure of the second antenna 22, wherein the common conductor 231 is used to excite a resonant mode of the second antenna 22. The radiation conductor 222 features an inductive reactance; the coupling conductor 223 together with the second conductor 231*b* features a capacitive reactance. The radiation conductor 222, the coupling conductor 223 and the second conductor 231*b* jointly form a resonant structure having both the abovementioned features. The resonant structure regulates the input impedance of the second antenna 22 to make the excitation mode thereof have a superior impedance matching. The resonant structure also modulates the resonant reactance to create a filtering effect and effectively isolate the signal of the first antenna 21 from the second antenna 22 lest the signal of the first antenna 21 interfere with the second antenna 22. Thus is improved the isolation effect of the two antennae.

Via the design of the common unit 23, the present invention integrates the radiation conductors, the short-circuit members and the ground members of different antenna structures into a single structure using a common radiator. Via the design of feeding signal into the resonant structure, the present invention is exempted from mutual signal interferences of different antennae, and the gain of antenna radiation is free from the influence of signal interferences. As the present invention integrates several sets of antennae into a single structure, an electronic device no more needs several sets of antennae embedded thereinside. The multi-antenna integration module of the present invention not only occupies much less space but also is easy-to-layout and easy-to-assemble for various electronic devices. Further, it is unnecessary for the present invention to particularly consider the problem of radiation isolation of the casing when the radiation conductor is arranged inside an electronic device.

Figure 3:
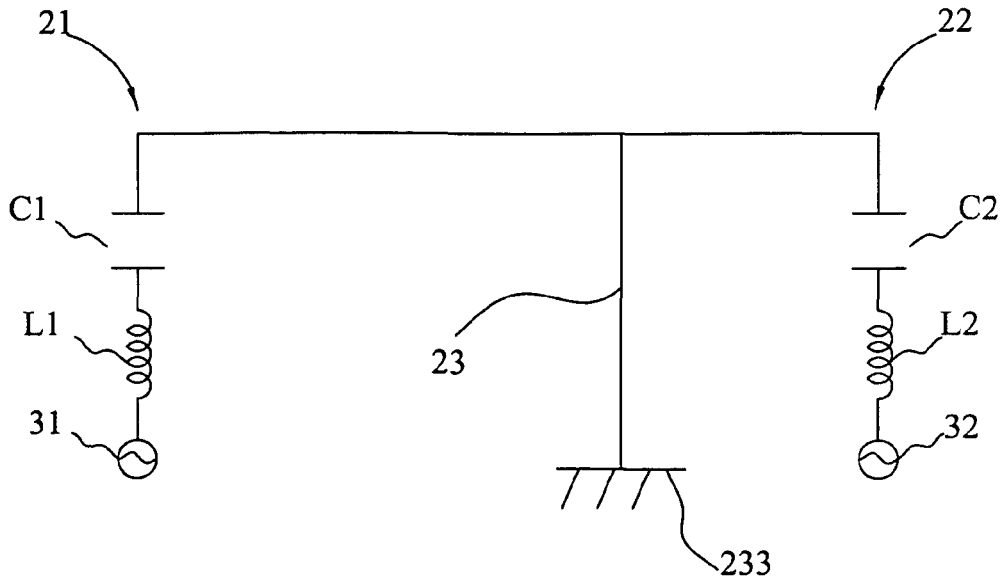
FIG. 3 is a diagram schematically showing a circuit according to the first embodiment of the present invention.

Refer to FIG. 3 a diagram schematically showing a circuit according to the first embodiment of the present invention. The first antenna 21 has a first signal source 31 carrying a high-frequency antenna signal. A first inductive reactance unit L1 transmits the first signal source 31 to a first capacitive reactance C1 in an electric induction way. Then, the first capacitive reactance C1 transmits the signal through the common unit 23 to the ground member 233 in a capacitive coupling way. The second antenna 22 has a second signal source 32 carrying a high-frequency antenna signal. A second inductive reactance unit L2 transmits the second signal source 32 to a second capacitive reactance C2 in an electric induction way. Then, the second capacitive reactance C2 transmits the signal through the common unit 23 to the ground member 233 in a capacitive coupling way. The first inductive reactance unit L1 and the first capacitive reactance C1 jointly form a resonant structure to modulate the input impedance of the first antenna 21 so that the system can have a superior impedance matching. The second inductive reactance unit L2 and the second capacitive reactance C2 jointly form a resonant structure to modulate the input impedance of the second antenna 22 so that the system can have a superior impedance matching.

Figure 4:
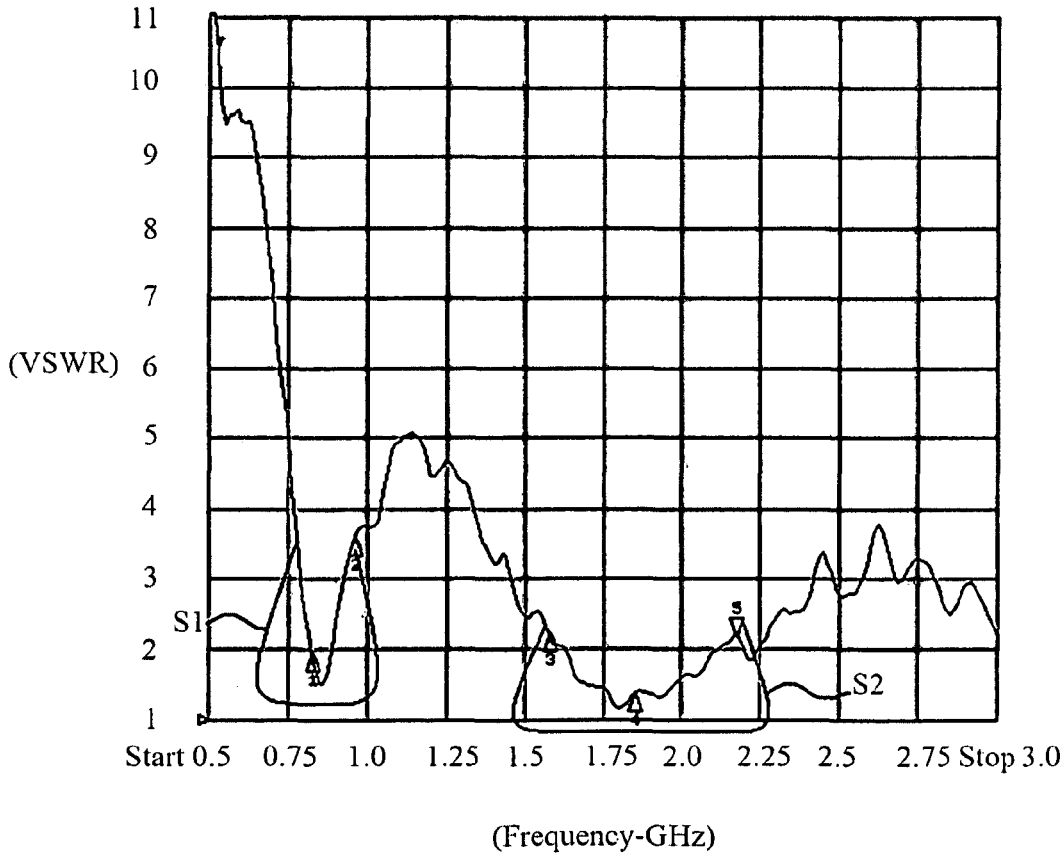
FIG. 4 is a diagram showing the measurement results of the voltage standing wave ratio of a first antenna according to the first embodiment of the present invention.

Refer to FIG. 4 a diagram showing the measurement results of the voltage standing wave ratio of the first antenna according to the first embodiment of the present invention. When a bandwidth S1 of the first antenna 21 is defined by a voltage standing wave ratio of 3.5, the operation frequency of the bandwidth S1 is between 824 and 960 MHz, and the frequency band covers the AMPS system (824-894 MHz) and GSM system (880-960 MHz). When a bandwidth S2 of the first antenna 21 is defined by a voltage standing wave ratio of 2.5, the operation frequency of the bandwidth S2 is between 1570 and 2170 MHz, and the frequency band covers the GPS system (1575 MHz), DCS system (1710-1880 MHz), PCS system (1850-1990 MHz) and UMTS system (1920-2170 MHz).

Figure 5:
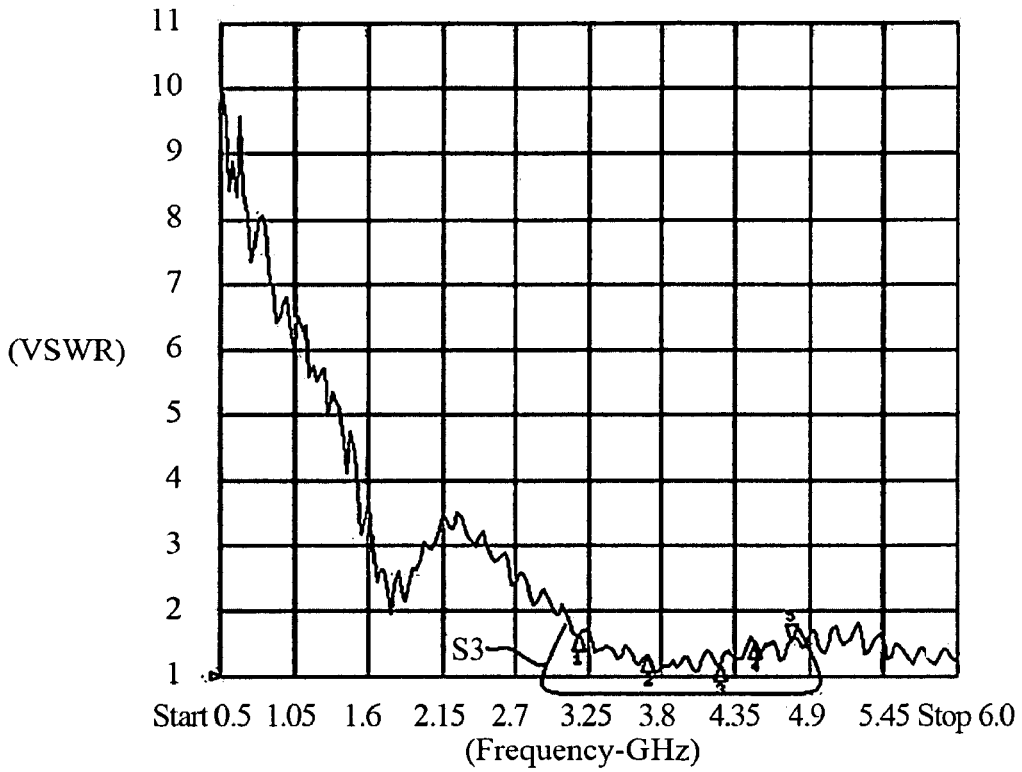
FIG. 5 is a diagram showing the measurement results of the voltage standing wave ratio of a second antenna according to the first embodiment of the present invention.

Refer to FIG. 5 a diagram showing the measurement results of the voltage standing wave ratio of the second antenna according to the first embodiment of the present invention. When a bandwidth S3 of the second antenna 22 is defined by a voltage standing wave ratio of 2, the operation frequency of the bandwidth S3 is between 3.1 and 4.9 GHz, and the frequency band covers the UWB system (3.1-4.9 GHz). From the measurement results, it is known that the common unit of the present invention can make the first antenna and the second antenna have a superior impedance matching.

Figure 6:
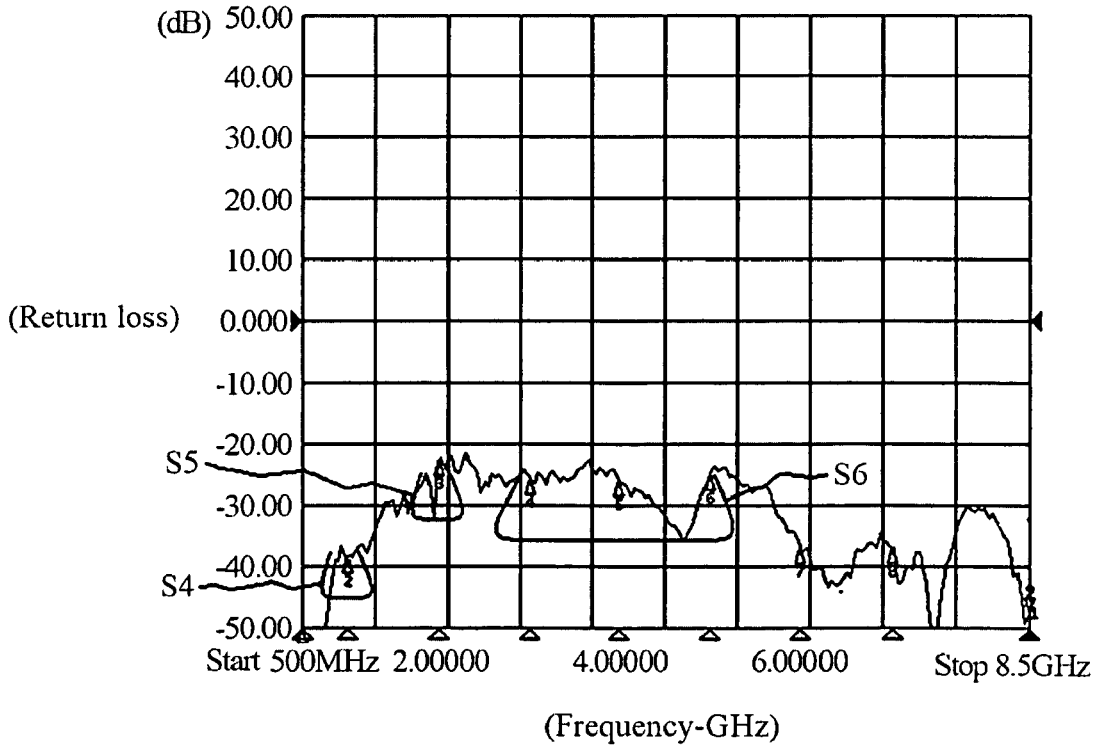
FIG. 6 is a diagram showing the measurement results of the isolation of a multi-antenna integration module according to the first embodiment of the present invention.

Refer to FIG. 6 a diagram showing the measurement results of the isolation of the multi-antenna integration module according to the first embodiment of the present invention. From the measurement results, it is observed: the isolation effect S4 is below −20 dB for the frequency band of the AMPS system (824-894 MHz) and GSM system (880-960 MHz), and the isolation effect S5 is also below −20 dB for the frequency band of the GPS system (1575 MHz), DCS system (1710-1880 MHz), PCS system (1850-1990 MHz) and UMTS system (1920-2170 MHz), and the isolation effect S6 is also below −20 dB for the frequency band of the UWB system (3.1-4.9 GHz). Therefore, the present invention can indeed inhibit the signal interference between two antennae and promote the isolation effect of antennae.

Figure 7:
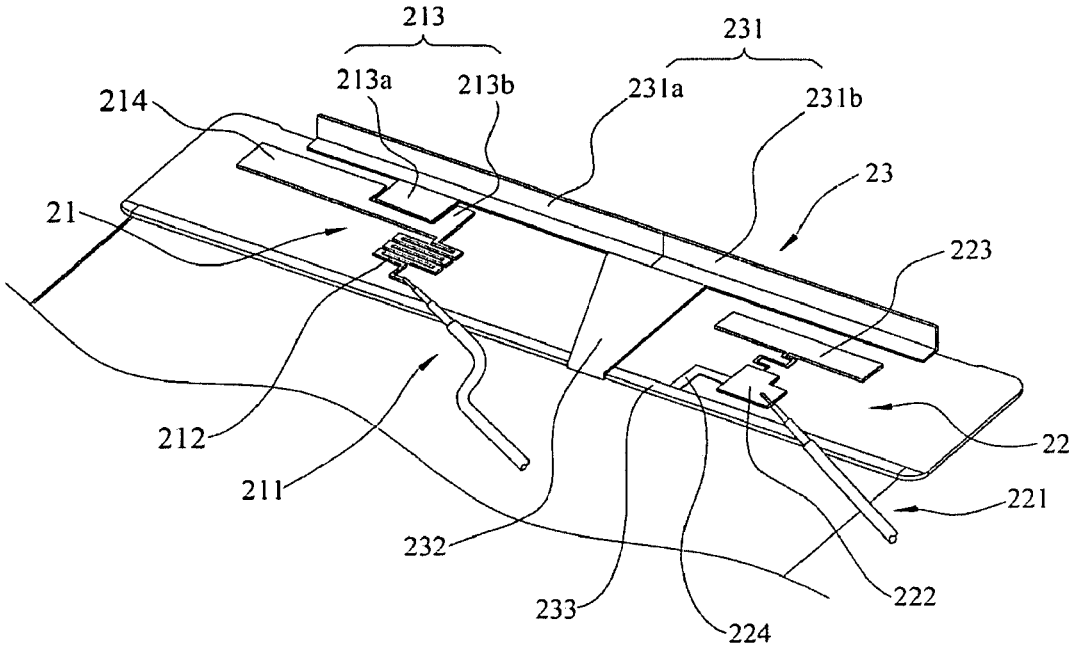
FIG. 7 is a perspective view of a multi-antenna integration module according to a second embodiment of the present invention.

Refer to FIG. 7 a perspective view of a multi-antenna integration module according to a second embodiment of the present invention. The second embodiment is similar to the first embodiment except the second antenna 22 additionally has a matching member 224. One end of the matching member 224 is connected to one side of the radiation conductor 222, and another end of the matching member 224 is connected to the common ground member 233. The matching member 224 is used to modulate the impedance matching of the second antenna 22 so that the system of the second antenna 22 can have a better operation bandwidth. In the second embodiment, the extension portion of the radiation conductor 222, which is connected to the coupling conductor 223, is fabricated into a serpentine shape to increase the inductive reactance of the second antenna 22, whereby the filtering effect of the second antenna 22 is increased, and the isolation effect between two antennae is promoted.

Figure 8:
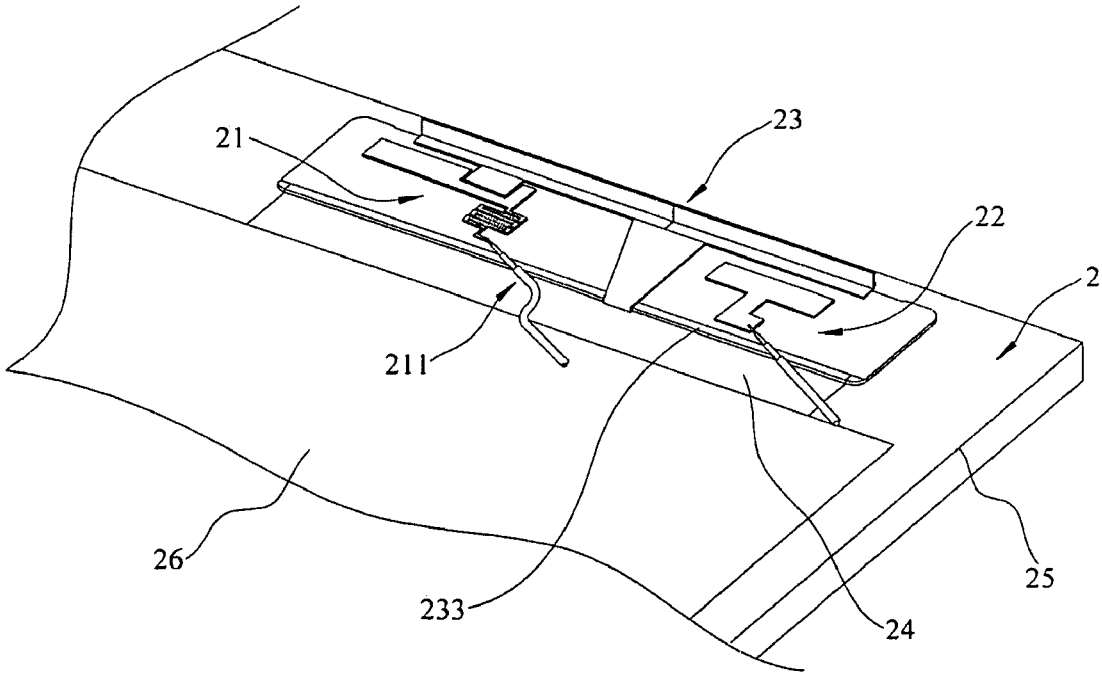
FIG. 8 is a perspective view showing that the first embodiment of the present invention is applied to a portable computer.

Refer to FIG. 8 a perspective view showing that the first embodiment of the present invention is applied to a portable computer. The multi-antenna integration module is arranged on the inner edge of a baseplate 25 of a portable computer 2. A tin foil 23 is stuck to one side of the common ground member 233, and the tin foil 24 is also stuck onto the entire inner surface of the baseplate 25. A screen 26 is arranged above the tin foil 24 and the baseplate 25. The baseplate 25 may be regarded as the ground plane of the entire multi-antenna integration module, and the tin foil 24 conducts the ground signal from the common ground member 233 to the baseplate 25. In the present invention, the common unit 23 integrates the radiation conductors, short-circuit members and ground members of different antenna systems into a single structure, whereby different antenna systems can share a common radiator. Thereby, the present invention can solve the conventional problem that several sets of antennae are installed on the edge of the baseplate 25 of a portable computer 2 and thus can reduce the space occupied by the antenna layout. Therefore, the multi-antenna integration module of the present invention is easy-to-layout and easy-to-assemble for various electronic devices.

From the above description, it is known that the present invention possesses novelty and non-obviousness and meets the conditions for a patent. However, it is to be noted that the embodiments described above are only to exemplify the present invention but not to limit the scope of the present invention. Therefore, any equivalent modification or variation according to the spirit of the present invention is to be also included within the scope of the present invention.

What is claimed is:

1. A multi-antenna integration module comprising
- a first antenna further comprising
  - a first feeder cable;
  - a feeder member with one end thereof connected to said first feeder cable;
  - a coupling unit further including a first coupling member connected to another end of said feeder member and a second coupling member, wherein a gap is formed in between said first coupling member and said second coupling member; and
  - an extension conductor extending from said first coupling member;
- a second antenna further comprising
  - a second feeder cable;
  - a radiation conductor with one end thereof connected to said second feeder cable; and
  - a coupling conductor with one side thereof connected to another end of said radiation conductor;
- a common unit further comprising
  - a common conductor including a first conductor and a second conductor, wherein said first conductor is connected to one side of said second coupling member, and a gap is formed in between said second conductor and another side of said coupling conductor;
  - a common short-circuit member with one end thereof connected to a junction of said first conductor and said second conductor; and
  - a common ground member connected to another end of said common short-circuit member.

2. The multi-antenna integration module according to claim 1, wherein said coupling unit, said extension conductor and said common unit are used to modulate a resonant mode of said first antenna.

3. The multi-antenna integration module according to claim 1, wherein said common conductor is used to excite a low-frequency resonant mode of said first antenna.

4. The multi-antenna integration module according to claim 1, wherein said extension conductor is used to excite a high-frequency resonant mode of said first antenna.

5. The multi-antenna integration module according to claim 1, wherein said radiation conductor, said coupling conductor and said common unit are used to modulate a resonant mode of said second antenna.

6. The multi-antenna integration module according to claim 1, wherein said common conductor is used to excite a resonant mode of said second antenna.

7. A multi-antenna integration module comprising
- a first antenna further comprising
  - a first feeder cable;
  - a feeder member with one end thereof connected to said first feeder cable;
  - a coupling unit further comprising a first coupling member connected to another end of said feeder member and a second coupling member, wherein a gap is formed in between said first coupling member and said second coupling member; and
- an extension conductor extending from said first coupling member;
- a second antenna further comprising
  - a second feeder cable;
  - a radiation conductor with one end thereof connected to said second feeder cable;
  - a coupling conductor with one side thereof connected to another end of said radiation conductor; and
  - a matching member with one end thereof connected to one side of said radiation conductor;
- a common unit further comprising
  - a common conductor including a first conductor and a second conductor, wherein said first conductor is connected to one side of said second coupling member, and a gap is formed in between said second conductor and another side of said coupling conductor;
  - a common short-circuit member with one end thereof connected to a junction of said first conductor and said second conductor; and
  - a common ground member connected to another end of said common short-circuit member and another end of said matching member.

8. The multi-antenna integration module according to claim 7, wherein said coupling unit, said extension conductor and said common unit are used to modulate a resonant mode of said first antenna.

9. The multi-antenna integration module according to claim 7, wherein said common conductor is used to excite a low-frequency resonant mode of said first antenna.

10. The multi-antenna integration module according to claim 7, wherein said extension conductor is used to excite a high-frequency resonant mode of said first antenna.

11. The multi-antenna integration module according to claim 7, wherein said radiation conductor, said coupling conductor and said common unit are used to modulate a resonant mode of said second antenna.

12. The multi-antenna integration module according to claim 7, wherein said common conductor is used to excite a resonant mode of said second antenna.

* * * * *